United States Patent [19]

Laursen

[11] 4,343,473

[45] Aug. 10, 1982

[54] GOLF SWING TRAINER

[76] Inventor: Paul D. Laursen, 1620 Buckingham, Lincoln Park, Mich. 48146

[21] Appl. No.: 167,704

[22] Filed: Jul. 11, 1980

[51] Int. Cl.[3] ..... A63B 69/36

[52] U.S. Cl. ..... 273/186 A; 273/186 C

[58] Field of Search ..... 273/186 A, 193 A, 80 B; 231/2 R

[56] References Cited

U.S. PATENT DOCUMENTS

| | | | |
|---|---|---|---|
| 1,529,305 | 3/1925 | Gatke | 273/186 A |
| 1,930,342 | 10/1933 | Graham | 273/193 A |
| 3,229,980 | 1/1966 | Silberman | 273/186 A |
| 3,231,281 | 1/1966 | Wallo | 273/193 A |
| 3,351,346 | 11/1967 | Strahan | 273/193 A |

*Primary Examiner*—George J. Marlo

*Attorney, Agent, or Firm*—Basile, Weintraub & Hanlon

[57] ABSTRACT

A golf swing trainer includes a hand grip and a shaft formed of a limp, flexible material which is connected to the grip at one end. The free end of the shaft is unravelled to form a soft tassel. In the preferred embodiment, the shaft is formed of a soft flexible nylon rope having a diameter of approximately 0.5 inch, and the characteristics of the rope are such that the rope will extend to a straight, stiffened form to create the feel of a correctly swung golf club only when the golf swing trainer is swung through the hitting area at a predetermined velocity and timing. The hand grip is, in one embodiment, constructed of a rigid material having an outer layer of a molded high friction material adhered thereto. Alternately, the entire hand grip is formed of the molded flexible material to form a flexible grip.

6 Claims, 3 Drawing Figures

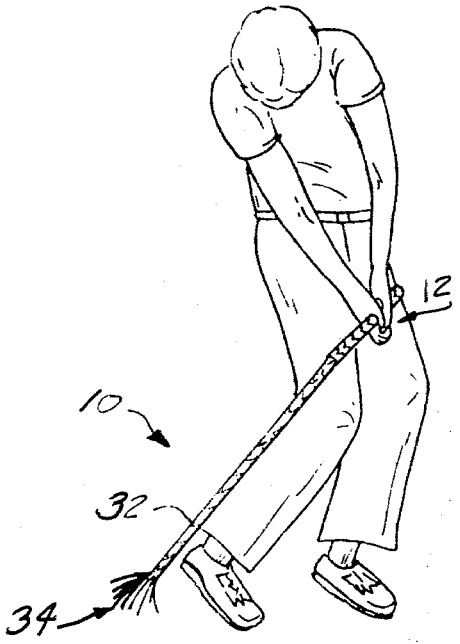
Fig-3
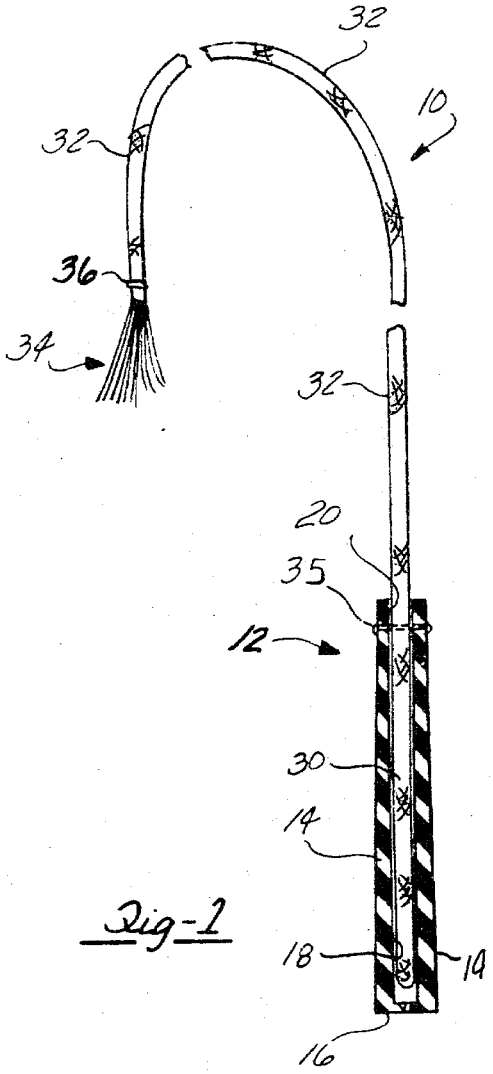
Fig-1
Fig-2
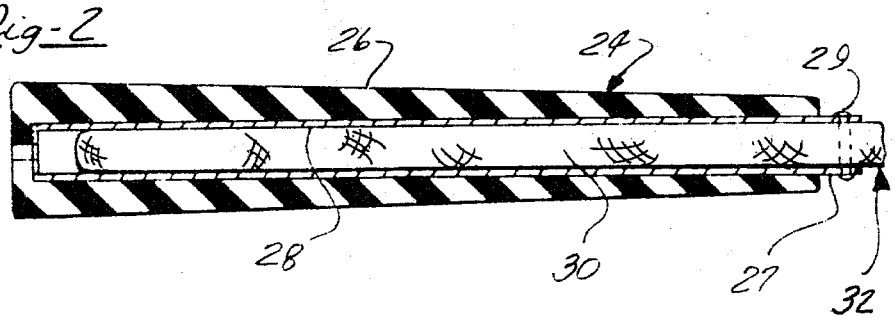

GOLF SWING TRAINER

BACKGROUND OF THE INVENTION

1. Field Of The Invention

This invention relates, in general, to golf clubs and, more specifically, to golf swing training devices.

2. Description Of The Prior Art

One of the more popular sports today is the game of golf. However, the swinging of a golf club properly in order to hit a golf ball accurately and with great distance involves a complicated series of movements which require a considerable amount of practice to perfect.

The proper golf swing involves a series of movements that begins with a back swing away from the ball and continues with a down swing having a weight shift and a hip turn that generates power and transfers the power to the shoulders, arms, hands, club shaft and club head, in that order. The hands and arms follow the lead of the lower body and thus are pulled down in a larger arc which gives the club head more time to accelerate. This causes a centrifugal force to be generated on the club head which leads to greater ball driving club head speed and thereby greater distance.

However, the timing and sequence of the above-described movements are easy to get out of order, especially with a conventional, stiff-shaft golf club. With the stiff-shaft golf club, it is not necessary to pull the club head into the hitting area; rather, it can be thrown, cast or pushed by the arms and hands alone with no assistance from the lower body at all.

In order to teach the proper sequence and timing of the movements in a proper golf swing, many attempts have been made to provide golf swing training devices which teach the correct swing. Such training devices include a golf club in which the golf club shaft is hinged at an intermediate point so as to bend under an improper movement during the swing.

A similar golf practice club includes a metal chain which is affixed to the end of a short shaft. A weight is affixed to the end of the chain which jerks the club if the down swing is started prematurely.

Although both of the above-described golf swing training devices contribute, with considerable practice, to the perfection of the golf swing, they present several disadvantages when used. For one, the hinged shaft or the weight at the end of the chain attached to the shaft create a danger for the golfer during the back swing since the club may flex or bend and cause the end of the club or the weight to strike the golfer. Concern by the golfer for such an occurrence undoubtedly will detract from total concentration on the proper golf swing and thereby reduce the overall effectiveness of the training device.

For another, a proper golf swing requires the generation of centrifugal force by the body of the golfer himself. In the above-described training devices, the swing of the weighted club generates additional forces by its weight which are not present in the swinging of a normal golf club. With the hinged shaft club, the hinge adds an additional lever to the golf swing which generates forces not occurring during a normal swing. Thus, both of the above-described golf training devices do not exactly simulate a proper golf swing when used to teach the proper sequence of movements.

Thus, it would be desirable to provide a golf swing training device which overcomes the problems of prior art training devices in teaching the proper sequence of movements required in a golf swing. It would also be desirable to provide a golf swing training device which insures that the forces generated during the swing are generated completely by the body of the golfer himself. It would also be desirable to provide a golf swing training device which insures that all parts of the body, not just the arms and hands, are used in the golf swing. Finally, it would be desirable to provide a golf swing training device which presents no danger of injury to the golfer during its use.

SUMMARY OF THE INVENTION

There is disclosed herein a new and improved golf swing trainer. The golf swing trainer comprises a hand grip and a shaft constructed of a limp, flexible material which is connected to the grip at one end. Preferably, the shaft comprises a soft, flexible nylon rope which has the free end thereof frayed or unravelled to form a tassel. The hand grip may, in one embodiment, be formed of a rigid material or, alternately, may be completely flexible like the shaft.

The unique golf swing trainer of this invention overcomes the problems of prior art golf swing training devices in teaching the proper sequence of movements in a golf swing. Due to the soft flexible nature of the shaft, the golf swing trainer of this invention cannot be pushed or thrown at the ball using the arms and hands of the golfer only. Rather, the golf swing trainer must be pulled into the hitting area using the entire body. The golfer instinctly realizes that the only way the soft, flexible shaft can be pulled through the hitting area with sufficient speed to stiffen or extend the flexible shaft is to use the entire body in the swing. The timing and sequence of the movements comes naturally to the golfer such that he can generate sufficient centrifugal force himself in order to pull the shaft through the hitting area with sufficient velocity to completely extend or stiffen the shaft.

Furthermore, the golf swing trainer of this invention is constructed so as to be completely safe in use. The free end of the shaft is then tied or unravelled for a short distance to form a soft tassel. This prevents any chance of injury to the golfer during the swing that exists with other golf swing training devices which use hinged shafts, or a chain having a weight affixed to the free end thereof.

BRIEF DESCRIPTION OF THE DRAWING

The various features, advantages and other uses of this invention will become more apparent by referring to the following detailed description and drawing in which:

FIG. 1 is an elevational view, partly in section, of the golf swing trainer constructed according to one embodiment of this invention;

FIG. 2 is a partial sectional view of the hand grip of the golf swing trainer illustrated in FIG. 1 constructed according to another embodiment of this invention; and FIG. 3 is a pictorial representation of the golf swing trainer of this invention in use.

DESCRIPTION OF THE PREFERRED EMBODIMENTS

Throughout the following description and drawing, identical reference numbers are used to refer to the same component shown in multiple figures of the drawing. Referring now to the drawing, and to FIG. 1 in particular, there is shown a golf swing trainer 10 constructed according to one embodiment of the invention. The golf swing trainer 10 functions to train a golfer in the proper sequence and timing of movements that are required for a properly executed golf swing.

As shown in FIG. 1, the golf swing trainer 10 of this invention includes a hand grip, denoted generally by reference number 12. The hand grip 12 is adapted to be grasped by the golfer in a conventional two handed grip.

The hand grip 12 is in the form of a hollow, cylindrical sheath which includes annular, tapered side walls 14 and an integrally formed end wall 16 which define an interior space 18 therebetween. The hand grip 12 further includes an open end 20 disposed opposite from the integral end wall 16. The hand grip 12 may be formed of any suitable length so as to comfortably accommodate the two handed grip utilized in the game of golf.

The hand grip 12 may be formed of any suitable material that provides a comfortable high friction surface for the hands of the golfer, and which is conventionally employed for golf club grips. Although a rubber is preferred and illustrated in FIG. 1, it will be understood that any other material, such as a synthetic material, may be utilized to form the hand grip 12 of this invention. In the embodiment illustrated in FIG. 1, the hand grip 12 is formed so as to be completely flexible. In this construction, a first end portion 30 of a shaft 32 is disposed within the hollow space 18 within the hand grip 12 substantially to the end wall 16. The first end portion 30 of the shaft 32 is secured in position within the hand grip 12 by any conventional means, such as an adhesive or by the use of a plurality of threads 35 which extend completely through the side walls 14 of the hand grip 12 and the first end portion 30 of the shaft 32 approximate the open end 20 of the hand grip 12.

Alternately, the golf swing trainer of this invention may be constructed with a rigid hand grip, as shown in FIG. 2. The hand grip 24 comprises an outer substantially cylindrical sheath 26 of a flexible high friction material identical to that described in the previous embodiment illustrated in FIG. 1. The hand grip 24 further includes a second inner cylindrical member 28 formed of a rigid material, such as a metallic material. The inner member 28 is in the form of a hollow cylindrical member having annular, tapered side walls and an end wall which is slightly smaller in diameter than the outer member 26 such that the inner member 28 may be inserted therein and secured thereto by any conventional means, such as an adhesive, not shown. A second end 27 of the inner cylindrical member 28 extends outward beyond the open end of the outer member 26. The first end portion 30 of the shaft 32 is inserted within the inner member 28 of the hand grip 24 and secured thereto by any conventional fastening means, such as by pop rivet 29, which extends completely through the second end 27 of the inner member 28 and the first end portion 30 of the shaft 32.

Referring again to FIG. 1, the shaft 32 is in the form of an elongated member constructed of a limp, flexible material. The shaft 32 is secured within the hand grip 12 at a first end 30, as described above.

The shaft 32 is formed of limp, flexible material which flexes when the golf swing trainer 10 is swung and is capable of extending to a stiffened state when the golf swing trainer 10 is swung through the hitting area at the proper velocity and in the correct manner. Preferably, the shaft 32 is formed of 100 percent soft, flexible nylon rope. In the preferred embodiment, nylon rope of approximately ½ inch diameter and from 36 to 43 inches in length, measured from the end of the hand grip 12 to the free end of the shaft 32, is utilized.

As illustrated in FIG. 1, the free end 34 of the shaft 32 is in the form of a soft tassel. The tassel 34 is formed by unravelling the free end of the shaft 32 for a short distance. The free end 34 is then tied off, such as by a thread 36 which extends completely around the rope and then adhered in position, such as by an adhesive, so as to prevent further unravelling of the free end 34 of the shaft 32. The tassel thus presents a soft end to the shaft 32 which prevents a chance of injury to the golfer as he swings the golf swing trainer 10 of this invention. Alternately, a high strength adhesive, alone, may be deposited about the upper terminus of the tassel to prevent further unravelling without the need for the thread.

In use, the golf swing trainer 10 is grasped by the golfer in a conventional grip around the hand grip 12. The golfer then proceeds to execute a golf swing in which the golf swing trainer 10 is moved in a back swing away from the hitting area. At the completion of the back swing, a down swing with a weight shift and a hip turn is executed that generates power and transfers the power to the shoulders, arms, hands, club shaft and club head, in that order. It should be noted that because of the construction of the golf swing trainer 10, the back swing must be completed before beginning the down swing; otherwise the shaft 32 will go limp and not provide the desired result. Assuming a completed back swing, the hands and arms of the golfer follow the lead of the lower body and are thus pulled downward in a large arc which gives the end of the shaft 32 more time to accelerate. This causes a centrifugal force to be generated at the end of the shaft 32 which causes the shaft 32 to extend to a straightened state as the golf swing trainer 10 is moved through the hitting area where a golf ball would normally be situated. It is only by use of the proper sequence of timing of the above-described movements, which involve the lower body and not just the arms and hands of the golfer, that a sufficient centrifugal force can be generated on the shaft 32 to cause it to be extended to a straightened state as it is pulled through the hitting area at maximum velocity. The golfer instinctively realizes the necessary sequence and timing of the movements that are required in order to properly swing the golf swing trainer 10; which movements can be easily transferred to a conventional golf club.

Thus, there has been disclosed herein a new and improved golf swing trainer which comprises a hand grip and a shaft formed of a limp, flexible material which is connected to the grip at one end thereof. The golf swing trainer of this invention uniquely overcomes the problems associated with prior art golf swing training devices in that it insures that the forces generated during a golf swing are generated completely by the body of the golfer and not just by his arms and hands. Further, the golf swing trainer of this invention is constructed so as to present no danger of injury to the golfer as it is swung.

What is claimed is:

1. A golf swing trainer consisting essentially of:

a hand grip;

a shaft formed of a flexible rope, said shaft connected to said hand grip at one end and having an opposed unweighted, free end unravelled for a predetermined distance to present a soft end on said shaft;

means, affixed to the shaft at the predetermined distance, for preventing further unravelling of the free end of the shaft;

the characteristics of the rope being such that the rope will extend to a straight, stiffened form to create the feel of a correctly swung golf club only when the golf swing trainer is swung through the hitting area at a predetermined velocity and timing.

2. The golf swing trainer of claim 1 wherein the shaft comprises a flexible nylon rope.

3. The golf swing trainer of claim 1 wherein the hand grip comprises a hollow cylindrical sheath which presents a high friction surface to the hands of the golfer.

4. The golf swing trainer of claim 3 wherein the hand grip further comprises a hollow cylindrical member disposed interiorly of the outer sheath and secured thereto, said inner member being formed of a rigid material adapted to receive one end of the shaft therein in secure engagement.

5. The golf swing trainer of claim 3 wherein the sheath is formed of a flexible material.

6. The golf swing trainer of claim 1 wherein the flexible rope has a diameter of approximately 0.5 inches.

* * * * *